United States Patent [19]

Houston

[11] 4,187,445

[45] Feb. 5, 1980

[54] SOLENOIDAL ELECTRIC FIELD LAMP WITH REDUCED ELECTROMAGNETIC INTERFERENCE

[75] Inventor: John M. Houston, Schenectady, N.Y.

[73] Assignee: General Electric Company, Schenectady, N.Y.

[21] Appl. No.: 917,498

[22] Filed: Jun. 21, 1978

[51] Int. Cl.[2] ..... H01J 65/00; H05B 41/24

[52] U.S. Cl. ..... 315/54; 315/248

[58] Field of Search ..... 315/51-54, 315/57, 62, 70, 71, 248; 313/161

[56] References Cited

U.S. PATENT DOCUMENTS 4,128,785 12/1978 Ferro et al. ..... 315/248 X

*Primary Examiner*—Alfred E. Smith
*Assistant Examiner*—Charles F. Roberts
*Attorney, Agent, or Firm*—Lawrence D. Cutter; Joseph T. Cohen; Marvin Snyder

[57] ABSTRACT

A solenoidal electric field lamp comprises a plurality of toroidal ferrite cores connected to a radio frequency energy source and disposed in an ionizable gas. The cores are so connected and oriented that circulating discharge currents passing through each core produce magnetic dipole fields which tend to cancel one another. Near and far field electromagnetic interference is thus reduced even when the lamp is operated at higher, more efficient frequencies. The cores are disposed in a variety of configurations.

16 Claims, 15 Drawing Figures

SOLENOIDAL ELECTRIC FIELD LAMP WITH REDUCED ELECTROMAGNETIC INTERFERENCE

BACKGROUND OF THE INVENTION

This invention relates to solenoidal field lamps and in particular to methods and configurations for reducing electromagnetic interference generated by these lamps.

A typical solenoidal electric field lamp comprises a single toroidal ferrite core disposed in an ionizable fill gas and electrically connected to a radio frequency energy source by means of windings disposed about the core. While a large frequency range is possible for the operation of the energy source, typical sources operate between the frequency of approximately 50 kilohertz and approximately 5 megahertz. This high frequency energy source produces a constantly varying magnetic field within the ferrite core. The radiative effects of this core magnetic field may be minimized by symmetric placement of the electrical windings about the core. The changing magnetic field within the core, however, according to well established laws of electrodynamics, produces a circular electric field threading through the core. Since the core is disposed in an ionizable medium, a sufficiently strong electric field produces a substantially circular electrical current flowing through the ionizable medium. The resulting circulating currents produce a time varying magnetic dipole field which does produce undesirable radiant electromagnetic energy. The strength of the radiation varies as $(d/\lambda)^4$ where d is the diameter of the circular current loop and $\lambda$ is the wavelength at which the high frequency energy source operates. Thus, it is seen that at shorter wavelengths (higher frequencies) the strength of the electromagnetic interference conventionally produced is greater than that at higher wavelengths. Nonetheless, it is desirable to operate such lamps at smaller wavelengths because at these frequencies a much smaller ferrite core is needed and additionally the hysteresis losses in the ferrite are greatly reduced.

The toroid is typically disposed in an ionizable fill gas contained within a translucent envelope internally coated with a phosphor material. The fill gas typically comprises mercury vapor enclosed in a glass, alumina or quartz envelope. The electric discharge current through the fill gas (typically 8 amperes at 5 volts) causes the emission of ultraviolet radiation which is absorbed by the phosphor coating and converted to visible wavelengths. If a purely ultraviolet lamp is desired, then the phosphor coating may be omitted. As used herein and in the appended claims, however, is is to be noted that the term "visible", refers to radiation both in the visible region of the spectrum and in the near visible, ultraviolet, and infrared spectral regions.

SUMMARY OF THE INVENTION

In accordance with a preferred embodiment of the present invention, a plurality of toroidal magnetic cores (that is, cores exhibiting a low magnetic reluctance) are disposed in an ionizable fill gas and particularly connected to the radio frequency energy source. More particularly, the cores are oriented within the envelope containing the fill gas and connected to the energy source in such a way that the magnetic dipole fields associated with the current loops threading through each of said cores tend to cancel or destructively interfere so that, particularly at distances removed from the lamp, the electromagnetic interference is reduced. This result is obtained by a judicious selection of the winding directions about each core and by judicious placement of the cores with respect to one another. For the most practical case involving only a pair of cores, each core receives the same amount of energy from the high frequency source and each core also possesses substantially the same dimensions, so that equal and opposite magnetic dipole moments are produced. A variety of core position configurations are shown for both globular and tubular envelopes.

Accordingly, it is an object of the present invention to provide solenoidal electric field lamps capable of operating at increased, more efficient frequencies, with a greatly reduced level of electromagnetic interference. It is a further object of the present invention to provide solenoidal electric field lamps having cores that operate at a lower temperature with a decrease in hysteresis losses within said cores.

DETAILED DESCRIPTION OF THE INVENTION

Figure 1:
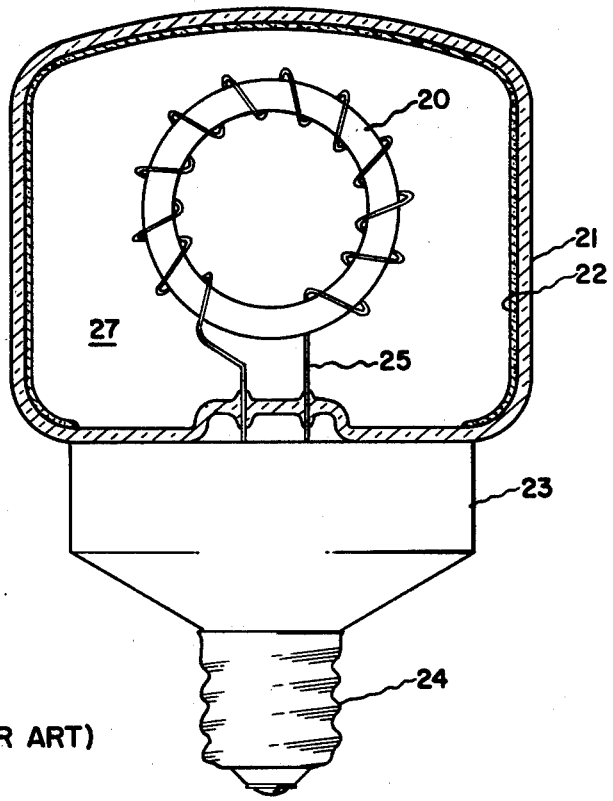
Fig. 1 (PRIOR ART)
FIG. 1 is a partial sectional side elevation view of a solenoidal electric field (SEF) lamp of the prior art.

FIG. 1 shows a conventional prior art form of an SEF lamp. Here a toroidal ferrite core 20 is electromagnetically coupled to radio frequency energy source 23 through windings 25 disposed about the core. The core is disposed in an ionizable fill gas 27 typically comprising an inert gas such as argon or krypton plus mercury vapor. The fill gas is contained in an envelope 21 which is transparent and possesses an internal phosphor coating 22. The radio frequency energy source is typically a solid state device serving to convert alternating line current to radio frequency energy. The energy source is advantageously packaged so as to include a standard Edison light bulb base 24. In fact, the acronym SEF is sometimes construed to mean Screw-in Edison-base Fluorescent lamp. Such an apparatus is peculiarly useful as providing an energy efficient replacement for the standard incandescent lamp.

Prior art SEF lamps conventionally operate at a frequency of approximately 50 kilohertz. At this frequency, there are significant hysteresis losses in the ferrite which adversely affect the efficiency of the lamp. Additionally, at this relatively low frequency, the size and mass of the ferrite core are relatively large compared to the size and mass of cores usable at higher frequencies. For example, a ferrite core for operation at 2 megahertz has a mass equal to only one-fourth of the mass of the ferrite core needed for operation at 50 kilohertz. Additionally, the hysteresis losses associated with a core operating at 2 megahertz are only one-sixteenth of the losses occurring in a core operating at 50 kilohertz. For these reasons, operation at relatively high frequencies offers significant advantages. However, the undesired electromagnetic interference generated by SEF lamps increases rapidly with increasing frequency.

The SEF lamps employed herein greatly reduced this electromagnetic interference while still permitting operation at relatively high frequencies.

Figure 2:
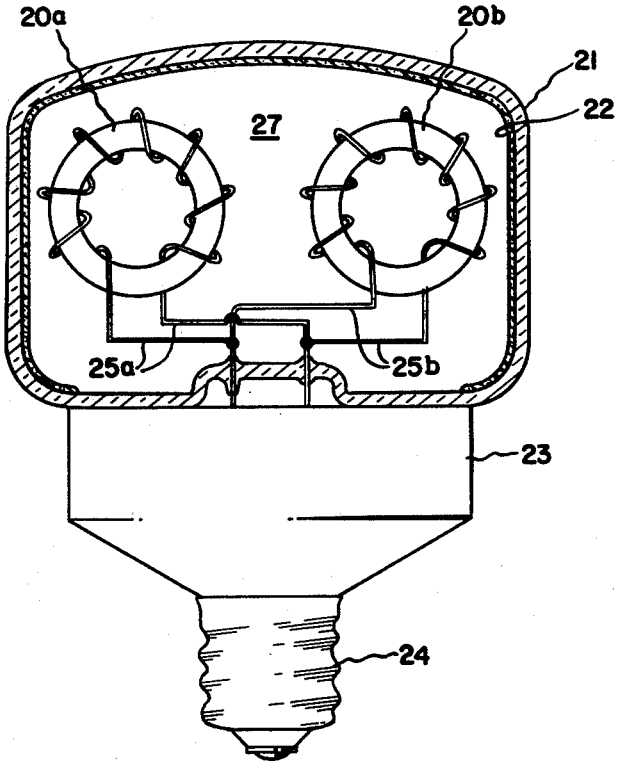
FIG. 2 is a partial sectional side elevation view of an SEF lamp in accordance with the present invention illustrating two toroidal cores in a globular envelope.

FIG. 2 illustrates a preferred embodiment of the present invention in which there is included within envelope 21 two toroidal ferrite cores **20*a* and 20*b* coupled to radio frequency energy source 23 through windings and leads 25*a* and 25*b***, respectively. The direction of the windings is an essential feature of this invention. Another related essential feature is the orientation of the ferrite toroids. The connection to the energy source and the orientation of the toroids are chosen so that electromagnetic interference is reduced.

Figure 3:
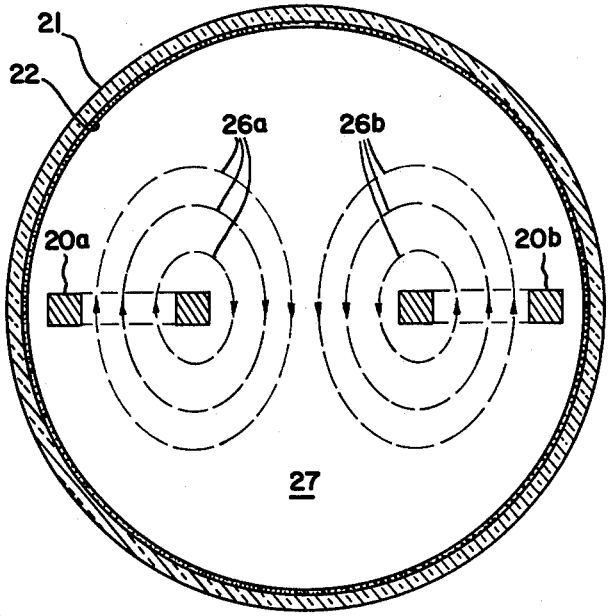
FIG. 3 is a top sectional view of an SEF lamp as shown in FIG. 1, further detailing circulating discharge current flows.

FIG. 3 is particularly useful in explaining how this interference reduction occurs. FIG. 3 is a top sectional view of FIG. 2 and further shows the circulating discharge current paths **26*a* and 26*b*. For example, if it is assumed that the current is increasing into the left winding lead in FIG. 2, there is induced an increasing magnetic field in the ferrite toroid circulating in a clockwise direction. A sufficiently rapidly increasing magnetic field induces an electric field which ionizes fill gas 27 and produces circulating discharge currents therein as is shown in FIG. 3. Associated with these circulating currents are changing magnetic dipoles. In FIG. 3, current loops 26*a* produce a magnetic dipole moment directed into the plane of the illustration and circulating currents 26*b*** produce a magnetic dipole moment pointing out of the plane of the illustration. These changing magnetic dipole moments tend to produce radiative magnetic interference. However, because of the direction of the flux flow within the core and the orientation of the cores, these radiative magnetic effects tend to cancel so that, especially when viewed from a distance, the two interfering wavefronts tend to cancel. In this way, electromagnetic interference is greatly reduced.

It is to be noted that the circulating discharge currents themselves do not cancel. A configuration in which these circulating discharge currents cancel would be highly undesirable and would produce minimal optical output.

It is to be further noted that the toroidal ferrite cores are maintained in position within the lamps shown herein by the inherent stiffness of the winding wire. Alternatively, other support means may be provided. It is also to be noted that in FIG. 3 windings on the cores are not shown; however, they are omitted only for the sake of clarity so that the circulating discharge current paths are not obscured.

Figure 4:
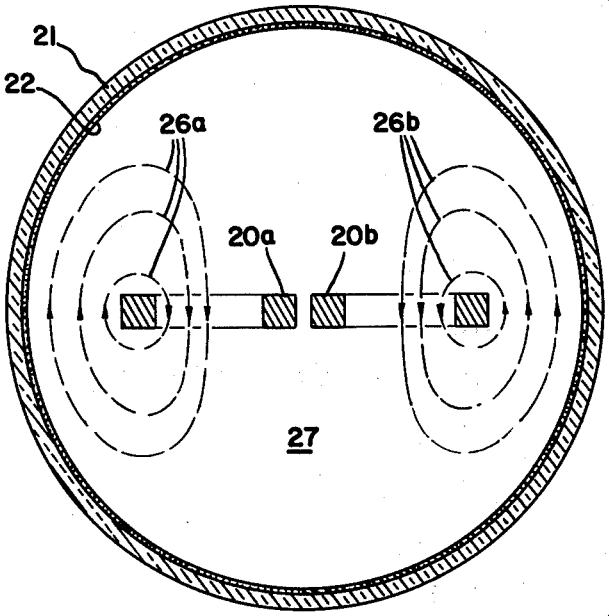
FIG. 4 is a top sectional view similar to that shown in FIG. 3 in which the cores are spaced away from the lamp envelope.

In FIG. 3, the toroidal cores are oriented in the same plane with their axes of revolution pointing in the same direction, as shown. This is also true of the cores shown in FIG. 4. However, the cores in FIG. 3 are disposed apart from one another so that they are relatively closer to the envelope 21 than to each other. Thus, in the configuration of FIG. 3 the preferred circulating discharge current passes between the cores as shown. On the other hand, the cores in FIG. 4 are positioned relatively closer to one another than to the envelope wall so that the preferred discharge current path passes between the cores and their respective adjacent envelope walls. This preferred path results because of its large cross-sectional area especially as compared with a path between the toroids which are relatively close together in this embodiment. The embodiment shown in FIG. 3 is slightly preferred in that slightly better cancellation occurs as a result of the closer proximity of the two interfering radiative magnetic dipoles.

Figure 5:
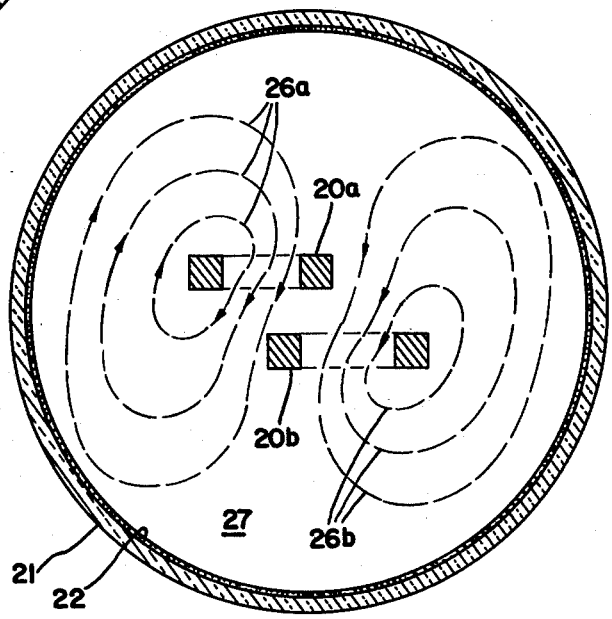
FIG. 5 is a top sectional view illustrating still another core position configuration.

FIG. 5 is an alternative embodiment of the present invention in which the cores are disposed having parallel axes but are arranged in an offset, nonplanar configuration. This configuration permits a smaller, more compact envelope to be used and is preferable in those situations in which the lamp size must be small.

Figure 6:
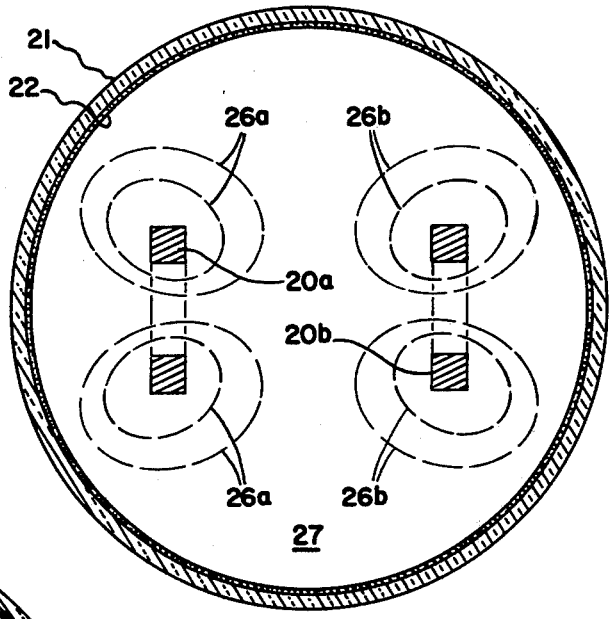
FIG. 6 is a top sectional view illustrating a core configuration in which the axes of two cores are coincident.
Figure 7:
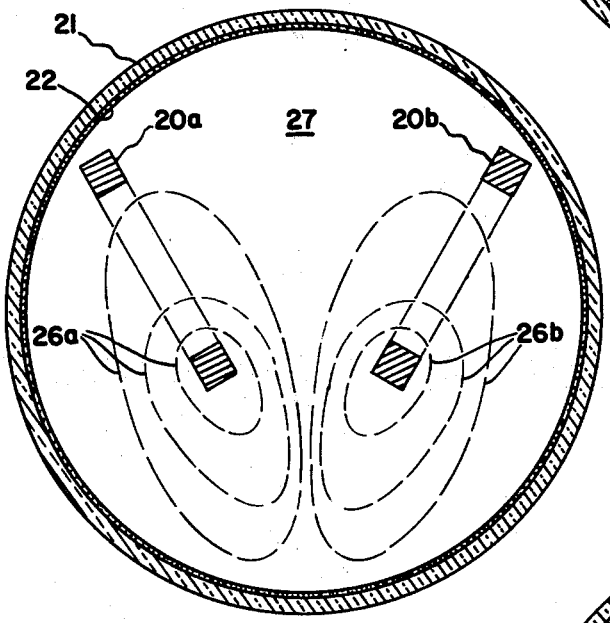
FIG. 7 is a top sectional view similar to FIG. 6 except that the cores are canted with respect to one another to produce preferential discharge paths.

FIG. 6 illustrates an embodiment of the present invention in which the axes of the toroidal cores are coincident and the cores are arranged in a spaced apart fashion as shown. This configuration, however, is not a preferred one because of the high degree of symmetry present. That is to say, the circulating current discharge paths will not be precisely as suggested in FIG. 6. Instead, the upper and lower portions of circulating discharge currents **26*a* will not both be present at the same instant. This occurs because the discharge current, being presented with two equally attractive discharge paths, will move back and forth between the upper and lower paths resulting in undesirable lamp flicker. This problem may be eliminated as shown in FIG. 7** by canting the toroids so that the planes in which they lie meet in an acute dihedral angle. This canting provides discharge paths of different cross-sectional area so that the path with the larger area is preferred.

Figure 8:
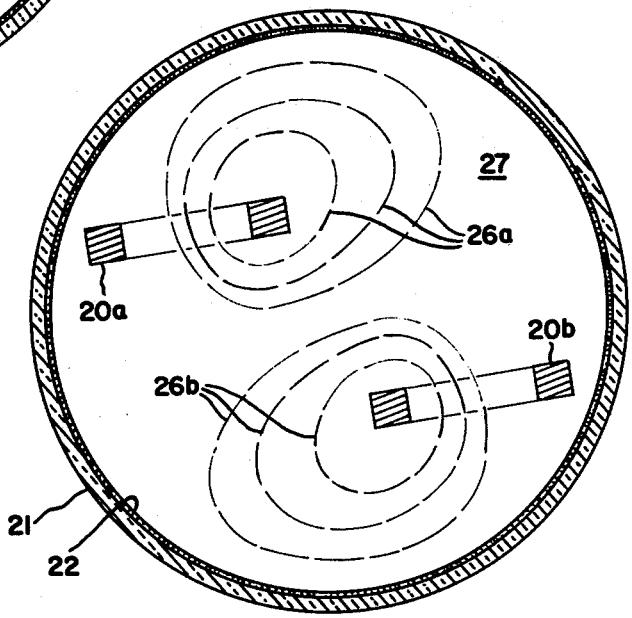
FIG. 8 is a top sectional view of an SEF lamp showing yet another core configuration.

FIG. 8 is another embodiment similar to that shown in FIG. 5 except that the cores, while being offset and parallel, are spaced apart relatively closed to the lamp envelope than to each other so that the discharge current circulates as shown.

Figure 9:
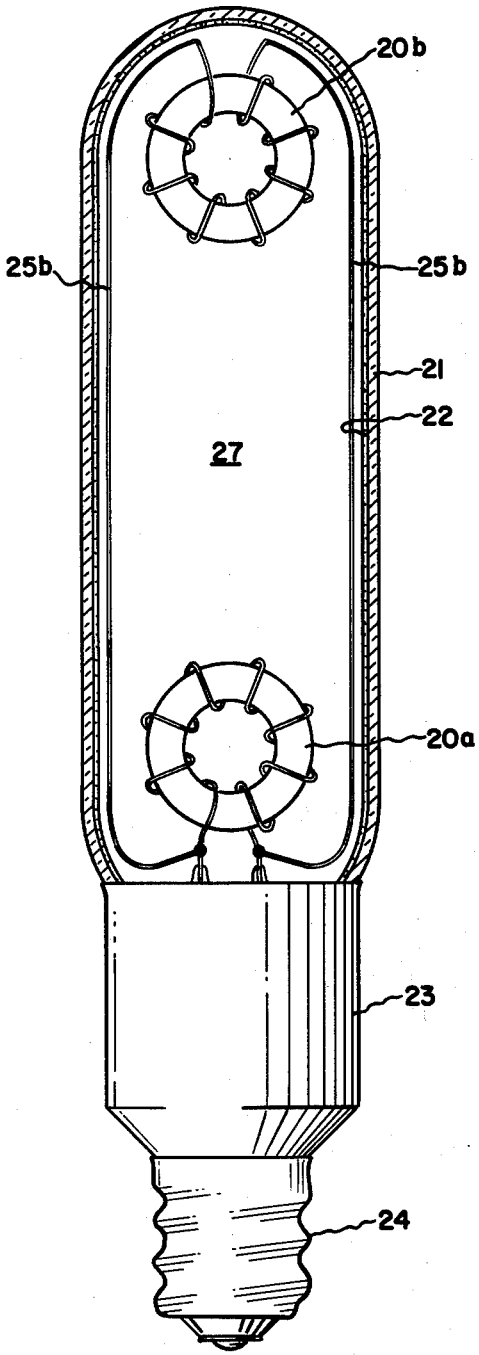
FIG. 9 is a partial sectional elevation view illustrating a tubular SEF lamp of the present invention in which the cores are disposed one on top of the other.

FIG. 9 illustrates a winding and core placement configuration which is particularly suited for tubular or elongated SEF lamps. In terms of core placement, FIG. 9 is most similar to FIG. 3. In FIG. 9, cores **20*a* and 20*b* are disposed at opposite ends of an elongated envelope 21 which is also typically interiorly coated with a phosphor 22. Again, the radio frequency energy source 23** typically comprises a suitably packaged solid state ballast circuit.

Figure 10:
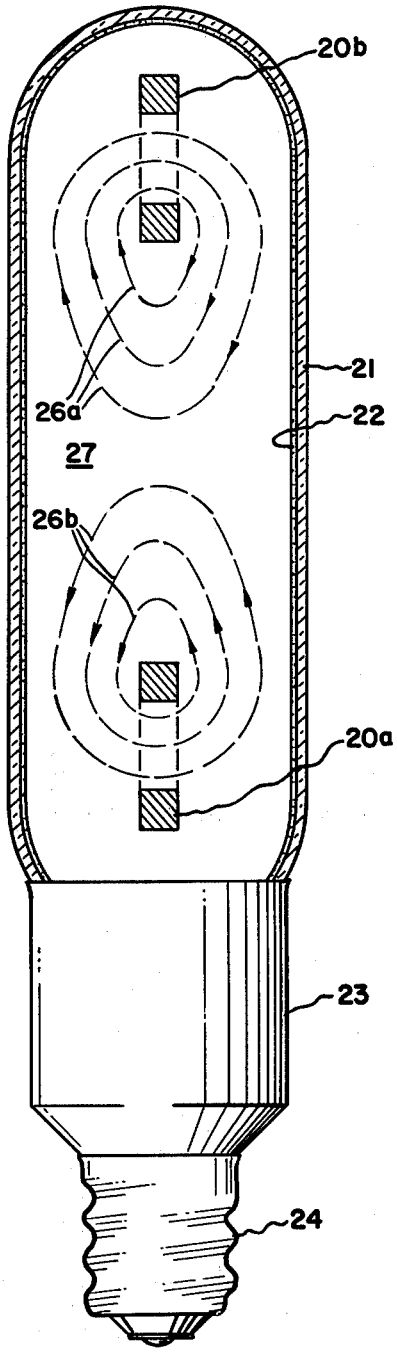
FIG. 10 is a partial sectional elevation view of FIG. 9 rotated 90° and further illustrating circulating current discharge paths.

FIG. 10 is a partial sectional view of the structure in FIG. 9 rotated 90° further illustrating the circulating current discharge paths 26*a* and 26*b*. It is again noted that between the cores the discharge currents reinforce one another but that since they circulate in opposing directions, the magnetic dipole moments associated therewith tend to cancel each other.

Figure 11:
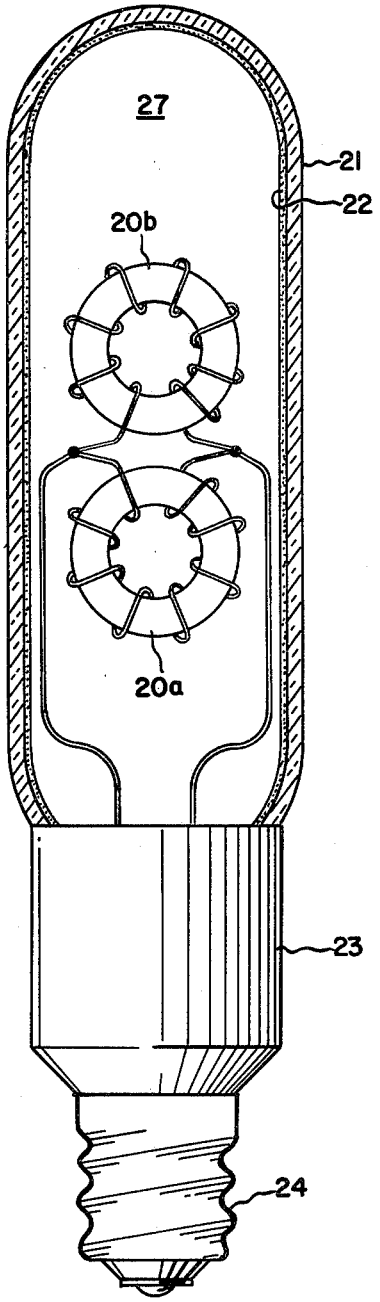
FIG. 11 is an SEF lamp similar to that shown in FIG. 9 except that the cores are disposed relatively closer to each other than to the ends of the tube.
Figure 12:
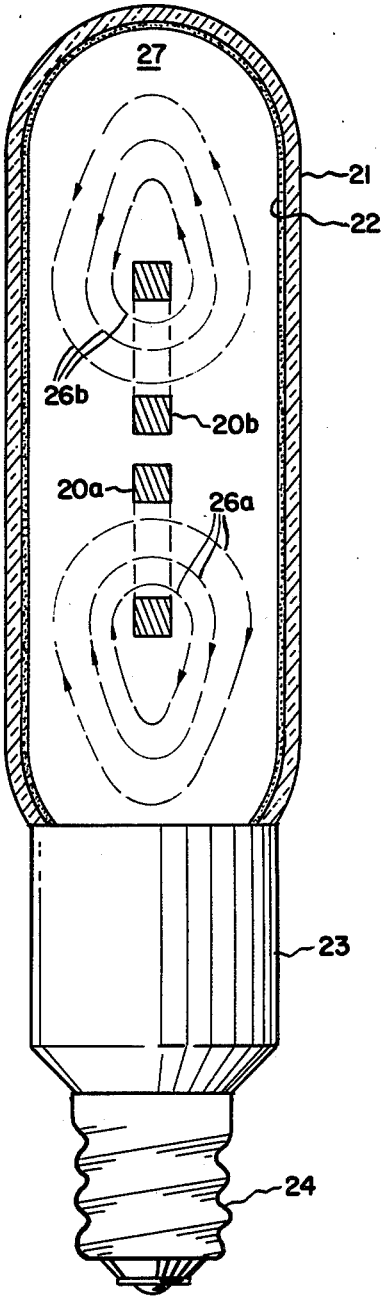
FIG. 12 is a partial sectional view of FIG. 11 rotated 90° further illustrating the associated circulating current discharge paths.

FIG. 11 is similar to FIG. 9 except that herein the cores are disposed relatively adjacent to each other as compared to the ends of the tubular envelope 21. Note that here too the winding direction is critically important in that it must be selected so that magnetic flux circulates in the same direction inside each toroidal ferrite core. This winding orientation insures that the discharge currents circulate in opposite directions thereby producing substantially cancelling magnetic dipole fields. The circulating discharge current paths from the lamp of FIG. 11 are shown in FIG. 12. FIG. 12 is closely analogous to FIG. 4, for the case of the globular envelope.

Figure 13:
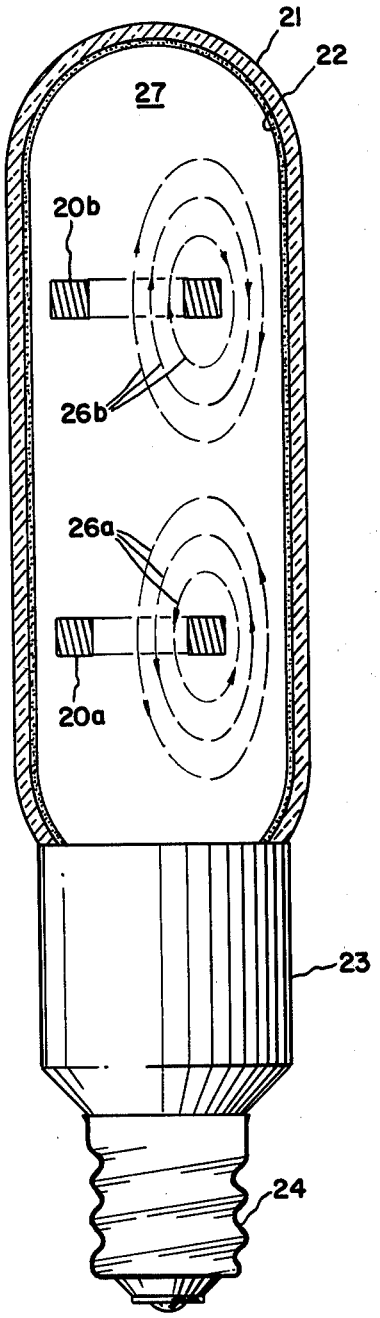
FIG. 13 illustrates a tubular SEF lamp having a pair of horizontally mounted toroidal cores.

FIG. 13 illustrates another embodiment of the present invention particularly suited for employment in tubular envelopes. Herein are shown two ferrite cores oriented in a parallel fashion with their axes coincident. Furthermore, the cores in FIG. 13 are both disposed relatively close to the same portion of envelope wall and the discharge currents circulate approximately as shown.

Figure 14:
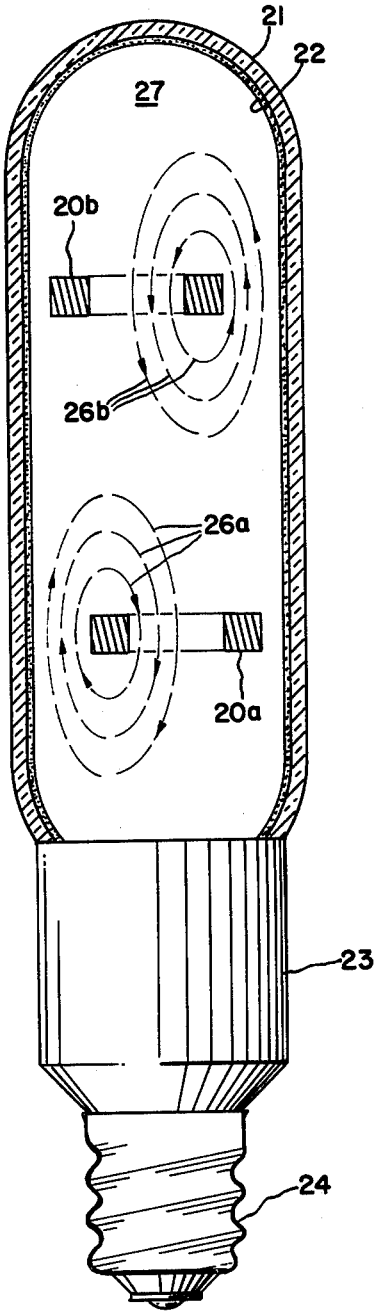
FIG. 14 is an SEF lamp similar to FIG. 13 except with said toroidal cores offset to provide more well defined discharge paths.

FIG. 14 illustrates yet another embodiment particularly suitable for use in a tubular envelope 21. FIG. 14 is very similar to FIG. 13 except that in the latter the cores are offset similar to those shown in FIGS. 5 or 8.

Figure 15:
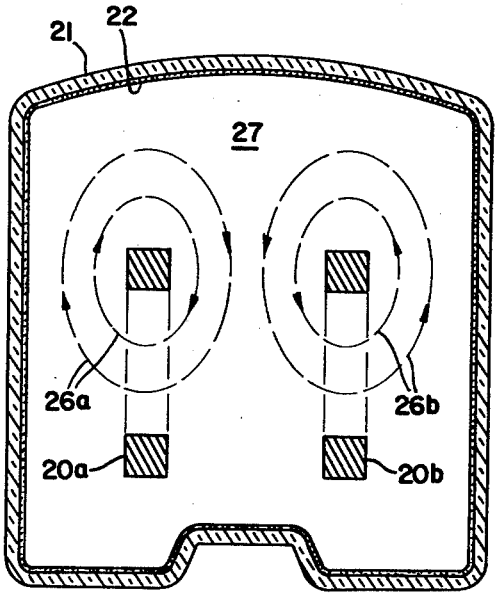
FIG. 15 is similar to FIG. 6 except that the envelope is dimensioned so as to produce preferred discharge paths over the top of the toroids.

FIG. 15 illustrates an embodiment in which the envelope dimensions are such that a relatively large fill gas volume exists above the cores, thus creating a preferred path for the discharge current above the cores as shown. This is to be contrasted with FIG. 6 in which relatively a short, squat envelope is preferable. Such an envelope possesses a height no greater than its diameter.

The two-core configuration illustrated herein is by far more practical than the single core configuration of the prior art. In these two-core configurations, it should be understood that the optimal advantage is to be gained by powering the two cores with equal amounts of electrical energy. This is explicity shown in FIGS. 2, 9, and 11 in which the two cores employed are connected in parallel. It is also be be understood that the magnetic cores employed are the same size and comprise the same material, typically ferrite. However, other configurations may be visualized in which there are three toroids, for example, in which case cancellation of the undesired radiative electromagnetic interference is best controlled by varying the placement, the size, and the energy delivered to each toroid so that effective magnetic dipole field cancellation occurs. Moreover, it is to be noted that parallel connection of the windings is not required and that cancellation may also be accomplished in a series connection.

A further advantage to be gained by using the present invention includes the fact that the energy supplied to each toroidal core can be halved (in the case of two cores) thereby reducing the thermal dissipation in each core. This is particularly important since excessive heating of the cores results in degradation of performance particularly as the core temperature approaches the Curie temperature of the ferrite material.

Accordingly, it can be appreciated that the present invention provides a solenoidal electric field lamp which generates significantly reduced levels of electromagnetic interference. It can also be appreciated that there are provided a variety of core configurations suitable for both globular and tubular lamps. Additionally, the lamps of the present invention provide significant thermal advantages over prior SEF lamps.

While this invention has been described with reference to particular embodiments and examples, other modifications and variations will occur to those skilled in the art in view of the above teachings. Accordingly, it should be understood that the appended claims are intended to cover all such modifications and variations as fall within the true spirit of the invention.

What is claimed is:

1. A solenoidal electric field lamp comprising:

a transparent envelope internally coated with a phosphor material which emits electromagnetic radiation at visible wavelengths upon stimulation by electromagnetic radiation;

a radio frequency electric energy source;

an ionizable fill gas disposed within said envelope; and a plurality of substantially toroidal shaped magnetic cores mounted within said envelope and electromagnetically coupled to receive said radio frequency energy from said source so as to establish a varying magnetic field which establishes a solenoidal electric field which ionizes said fill gas and produces therein circulating discharge currents, said cores being so connected to said energy source and so oriented within said envelope that the magnetic dipole fields produced by said discharge currents substantially oppose each other so as to reduce the level of radio frequency electromagnetic interference radiated by said lamp.

2. The lamp of claim 1 in which said plurality of substantially toroidal shaped magnetic cores consists of two cores each possessing substantially the same dimensions.

3. The lamp of claim 2 in which said cores are oriented so as to lie substantially in the same plane.

4. The lamp of claim 3 in which said cores are disposed relatively closer to each other than to said envelope so as to allow substantially all of the circulating discharge current to pass adjacent to said envelope.

5. The lamp of claim 3 in which said cores are disposed relatively closer to said envelope than to each other so as to allow substantially all of the circulating discharge current to pass between said cores.

6. The lamp of claim 2 in which said cores are oriented in distinct planes with the axes of said cores parallel.

7. The lamp of claim 6 in which said axes are separated by a distance not exceeding the radius of the cores.

8. The lamp of claim 7 in which the cores are spaced relatively closer to each other than to said envelope so that substantially none of the discharge current passes between said cores.

9. The lamp of claim 7 in which the cores are spaced relatively closer to said envelope than to each other so that substantially all of the discharge current passes between said cores.

10. The lamp of claim 6 in which the axes of said cores are coincident.

11. The lamp of claim 2 in which the two cores are disposed in planes which meet at an acute dihedral angle.

12. The lamp of claim 1 in which said envelope is short and squat.

13. The lamp of claim 1 in which said envelope is tubular.

14. The lamp of claim 1 in which said fill gas comprises an inert gas and mercury vapor.

15. The lamp of claim 1 in which the cores are disposed within and with respect to the envelope so as to produce preferred paths for the discharge current.

16. The lamp of claim 1 in which said cores comprise ferrite.

* * * * *